US005099615A

United States Patent [19]

Ruble et al.

[11] Patent Number: 5,099,615

[45] Date of Patent: Mar. 31, 1992

[54] AUTOMATED RIGID-DISK FINISHING SYSTEM PROVIDING IN-LINE PROCESS CONTROL

[75] Inventors: Frank D. Ruble, Saratoga; John N. Walsh, Pleasanton; Robert A. Smith, Berkeley, all of Calif.

[73] Assignee: Exclusive Design Company, Inc., San Mateo, Calif.

[21] Appl. No.: 744,916

[22] Filed: Aug. 14, 1991

Related U.S. Application Data

[62] Division of Ser. No. 410,952, Sep. 22, 1989, Pat. No. 4,964,242.

[51] Int. Cl.[5] ..... B24B 21/12

[52] U.S. Cl. ..... 51/165.71; 51/165.74; 51/165.77; 51/281 SF; 51/148; 51/140

[58] Field of Search ..... 51/165 R, 165.71, 165.74, 51/165.76, 165.77, 281 SF, 328, 140, 137, 148

[56] References Cited

U.S. PATENT DOCUMENTS

| | | | |
|---|---|---|---|
| 1,843,301 | 2/1932 | Player | 51/289 R |
| 3,481,083 | 12/1969 | David | 51/62 |
| 4,145,846 | 3/1979 | Howland | 51/141 |
| 4,262,452 | 4/1981 | Lopez | 51/281 SF |
| 4,374,689 | 9/1982 | Hammond | 51/145 R |
| 4,535,567 | 8/1965 | Seaborn | 51/145 R |
| 4,656,790 | 4/1987 | Mukai | 51/141 |
| 4,671,018 | 6/1987 | Ekhoff | 51/140 |
| 4,930,259 | 6/1990 | Kobylenski et al. | 51/281 SF |
| 5,018,311 | 5/1991 | Malagrino et al. | 51/140 |

*Primary Examiner*—M. Rachuba

*Attorney, Agent, or Firm*—Blakely, Sokoloff, Taylor and Zafman

[57] ABSTRACT

The present invention provides an automated rigid-disk finishing system with "fly-by-wire" control of each of the relevant parameters involved in the texturing process. The system includes an abrasive tape, a means for forcibly pressing the tape against the substrate to cut microscopic grooves into the substrate's surface, and a control means for simultaneously controlling the speed and tension of the tape and for sensing the tension developed in the tape on both sides of the tape/substrate interface. The described system is thus capable of establishing tape speed and tape tension simultaneously, while providing a measure of the actual work being accomplished on the rigid disk surface.

11 Claims, 6 Drawing Sheets

TAPE SPEED AND TENSION PROGRAMMED BY USER 70
TAPE SPEED/TENSION ESTABLISHED BY SERVO-MECHANISM WHILE TAPE IS UNLOADED 71
CALIBRATE SYSTEM BY RECORDING $\Delta_1$ AND $\Delta_2$ 72
LOAD DISK 73
RECORD WORK FACTOR ($F_3$) 74
$F_3$ < LIMIT ? 76
NO
FLAG CURRENT DISK 75
YES
CONTINUE PROCESSING 77
NO
PROCESS FINISHED ? 78
YES
UNLOAD DISK 79
YES
ANOTHER DISK ? 80
NO
FINISHED

AUTOMATED RIGID-DISK FINISHING SYSTEM PROVIDING IN-LINE PROCESS CONTROL

RELATED APPLICATIONS

This is a division of Ser. No. 07/410,952, filed 9/22/89.

This application is related to an application entitled "Apparatus For Texturing Rigid-Disks Used in Digital Magnetic Recording Systems", Ser. No. 410,987, filed 9/22/89; which has now been issued as U.S. Pat. No. 4,964,242, which application is assigned to the assignee of the present application.

FIELD OF THE INVENTION

This invention relates to the field of the electromechanical systems for texturing and finishing the surfaces of rigid disks.

BACKGROUND OF THE INVENTION

In present day data processing systems, it is desirable to provide a large amount of memory which can be accessed in a minimal amount of time. One type of memory which has enjoyed widespread use in the data processing field is that of magnetic media disk memories.

In general, disk memories are characterized by the use of one or more magnetic media disks stacked on a spindle assembly and rotated at a high rate of speed. Each disk is divided into a plurality of concentric "tracks" with each track being an addressable area of the memory array. The individual tracks are accessed through magnetic "heads" which fly over the disk on a thin layer of air. Typically, the disks are two-sided with a head accessing each side. In operation, these magnetic recording heads recover digital information from the recorded media by detecting magnetic flux reversals written onto the media.

Because of the small spacings and narrow tolerances involved in rigid-disk recording systems, the most important properties needed in advanced media are generally of a mechanical nature. Substrate and coating surfaces must be smooth to reduce noise and to reduce head-to media spacing. Mechanical wear resistance and magnetic uniformity are highly important for all types of media, but especially so for thin films or thin particular coatings. This means that the texturing process, which provides uniform microscopic grooves across the surface of the disk, is crucial to magnetic recording systems with high information density.

Texturing improves the properties of the magnetic rigid-disk in several ways. First of all, texturing removes the possibility of a Johansson Block effect occurring between the recording head and the disk surface. The Johansson Block effect refers to the tendency of the magnetic recording head to stick to a perfectly flat substrate surface due to the relative vacuum formed in between. The grooves prevent a vacuum from forming by allowing air molecules to penetrate the head/disk interface. The grooves, therefore, are essential to avoiding cohesion between the disk and head which may prevent the drive spindle from turning after a standstill.

The microscopic grooves also act as a reservoir for loose organic particulate matter which may find its way onto the disk's surface. In this way, the grooves function as tiny ditches to drain away contaminants from the disk surface where they might interfere physically or electrically with the head-media interface.

Another purpose of texturing is to enhance the magnetic properties of the rigid-disk surface by reducing the radial component of magnetization while intensifying the circumferential component. A large circumferential component of magnetization results in better differentiation between adjacent tracks on the magnetic surface.

In the course of manufacturing a magnetic disk, the substrate is first plated with nickle to a thickness of about 0.5 to 1.0 thousands of an inch and polished to a mirror finish. Standard substrate materials for rigid-disk recording media include high-purity aluminium and aluminum (4–5%) magnesium alloys. These substrate materials provide a uniform smooth surface which permits close head-to-media spacing in addition to reducing substrate-induced noise.

The next manufacturing step involves the actual texturing of the disk surface. The purpose of texturing, as mentioned, is to improve the physical and magnetic properties of the recording surface. In the texturing process, numerous microscopic grooves are cut circumferential into the disk's surface using either a fixed-abrasive or free-abrasive medium. In general, the grooves measure approximately $12 \times 12$ microinches in dimension. Each groove is separated from its nearest neighbor by approximately 20–30 microns. (Practically, the grooves are not located on a true circumference of the disk. Rather, the grooves are cross-hatched—intersecting at an approximate 10 degree angle to each other.)

Most texturing equipment utilizes an abrasive mineral, such as silicon carbide or aluminium oxide, for cutting the grooves. The mineral is bonded to a mylar-backed tape which is then passed over a cylindrical load roller. The tape is mechanically forced against the surface of the disk by the load roller. Commonly, two load roller assemblies are positioned side by side to texture the front and back surfaces simultaneously. To facilitate the process, the rigid-disk substrate is often rotated against the tape/roller system at a high rate of speed.

Numerous variations to this basic process exist. For instance, often a liquid is supplied at the tape/disk interface to lubricate and/or cool the disk surface during the cutting process. Cross-hatching of the grooves may also be accomplished by mechanically oscillating the roller across the radius of the disk, e.g., from the inside diameter to the outside diameter. As is appreciated by practitioners in the art, the quality of the microscopic grooves is extremely dependent on a great many process variables which have remained relatively uncontrolled in prior approaches.

After the rigid-disk surface has been textured, a thin magnetic film is applied to the surface of the disk. The thin magnetic film comprises the actual recording media. Most magnetic films are nickel-cobalt alloys which are deposited by either electrical plating, chemcial plating, evaporation or sputtering. The typical thickness of these films may range anywhere from 2 to 3 microinches.

Following the deposition of the magnetic media material, a protective overcoating (typically some sort of carbon compound) is sputtered onto the surface of the substrate. The overcoating is applied after the magnetic layer to provide abrasion resistance from the recording head. Buffing of the protective overcoat completes the processing of the magnetic rigid-disk.

There are a number of drawbacks associated with prior art texturing machines. For instance, prior approaches generally ignore the need for in-line process control because of the difficulty of measuring and controlling each of the various process parameters involved. Parameters, such as tape speed, tape tension, applied force, etc., usually must be manually preset in prior art systems before the start of a processing cycle. In other words, the control of such systems is completely "open-loop" in nature.

Most often, tape speed and tension are established by a DC motor and drag clutch arrangement that is calibrated by hand. However, once the work on the disks has commenced, there is little way of knowing whether any of the relevant parameters have changed during the processing cycle. For this reason, previous finishing systems have been incapable of furnishing quality control information to the user on a real-time basis. Furthermore, due to the lack of automation and instrumentation, prior art systems have been unable to provide the user with a measure of the actual work being performed at the disk/tape interface. Therefore, what is needed is an automated finishing system which provides in-line process control features.

As will be seen, the present invention provides an automated rigid disk finishing system with "fly-by-wire" control. That is, each of the relevant processing parameters are remotely programmed by the user and thereafter controlled by the finishing system without the need for manual adjustment. The described system is thus capable of establishing tape speed and tape tension simultaneously, while providing a measure of the actual work being accomplished on the rigid disk surface. Employing these features, the invented system achieves real-time, in-line process control for the first time in a disk finishing system.

SUMMARY OF THE INVENTION

A system for texturing the surface of a rigid-disk substrate used in magnetic recording systems is described. In one embodiment, the system comprises an abrasive tape and a means for forcibly pressing the tape against the substrate to cut microscopic grooves into the substrate's surface. The invention also includes a supply means for supplying the tape to the force application means and a collecting means for collecting the tape up after it has performed its work on the substrate surface.

A control means is also included for simultaneously controlling the speed and tension of the tape and for sensing the tension developed in the tape on both sides of the tape/substrate interface. The control means calculates this difference to compute the actual work being performed on the surface of the substrate.

BRIEF DESCRIPTION OF THE DRAWINGS

The novel features believed characteristic of the invention are set forth in the appended claims. The invention itself, however, as well as other features and advantages thereof, will be best understood by reference to the detailed description which follows, read in conjunction with the accompanying drawings, wherein:

DESCRIPTION OF THE PREFERRED EMBODIMENT(S)

The present invention covers an automated rigid-disk finishing system providing in-line process control features. In the following description, numerous specific details are set forth such as dimensions, materials, ect., in order to provide a thorough understanding of the present invention. It will be obvious, however, to one skilled in the art that these specific details may not be required to practice the present invention. In other instances, well-known elements and devices have not been described in detail, or have been shown in block diagram form, in order to avoid unnecessarily obscuring the present invention.

Figure 1:
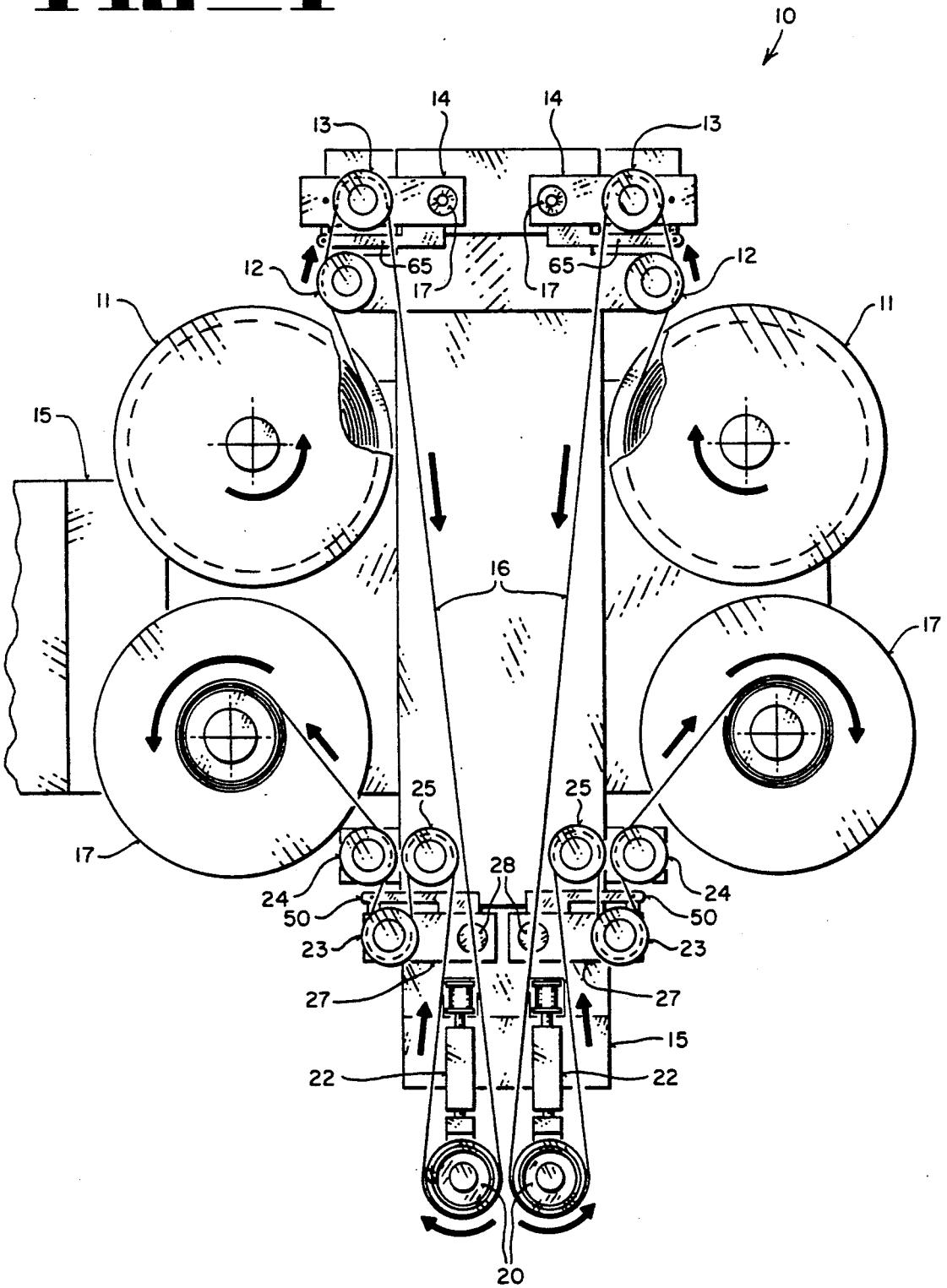
FIG. 1 is a front view of the transport mechanism of the texturing apparatus which is the subject of the present invention.

Referring to FIG. 1, a front view of the tape transport mechanism of the electro-mechanical texturing apparatus of the present invention is shown. Texturing apparatus 10 includes a symmetrical pair of assemblies whose function is to act in concert to simultaneously texture, or finish, the front and back surfaces of a rotating rigid-disk substrate. The substrate, also frequently referred to as the workpiece, is normally attached to a spindle and rotated at a relatively high velocity. An abrasive tape is then forcibly pressed onto the front and back surfaces of the workpiece by a pair of load roller assemblies, thereby cutting microscopic grooves into the disk's surfaces.

Each of the assemblies includes an abrasive tape 16 which comprises aluminum oxide, or some other similar abrasive, embedded in a binder system which is then coated onto a flexible mylar backing. Tape 16, which is approximately two thousands of an inch in thickness, is originally wound around supply reel 11. From there it is threaded around upper tape guides 12 and 13, around load roller 20, lower tape guides 25, 23 and 24; eventually to be collected by take-up reel 17. Take-up reel 17 is mounted to an ordinary DC gear motor 37 (see FIG. 2) which winds up tape 16 at a constant speed. The shaft of motor 37 is coupled to a transducer 38 which measures the shaft speed of motor 37. This aspect of the invention will be discussed in more detail later.

In a typical process, motor 37 turns at a rate such that approximately seven inches of tape are passed over load roller 20 per minute. Since a processing cycle for a single disk usually lasts nearly 20 seconds, only about 3 inches of tape is utilized. This normally amounts to less than one revolution of reel 17. In other words, the radius of the tape wound around reels 11 and 17 remains virtually constant during any given process cycle.

During texturing of the workpiece a portion of the tape—which may be hundreds of feet in length—is transferred from supply reel 11 to take-up reel 17. Tape guides 12, 13 and 23–25, along with an electrically-controlled brake 36 (again, see FIG. 2) attached to supply reel 11, provide proper tensioning of tape 16 during the texturing process. As motor 37 winds tape 16 at a constant velocity, brake 36 simultaneously establishes supply side tension in tape 16. Both motor 37 and brake 36 are controlled by servo mechanisms so that each may be programmed to a user-defined setting. Note that the arrows in FIG. 1 denote the direction that the tape travels during processing, while the arrows in FIG. 3 denote the direction of the various tape tension forces.

Figure 3:
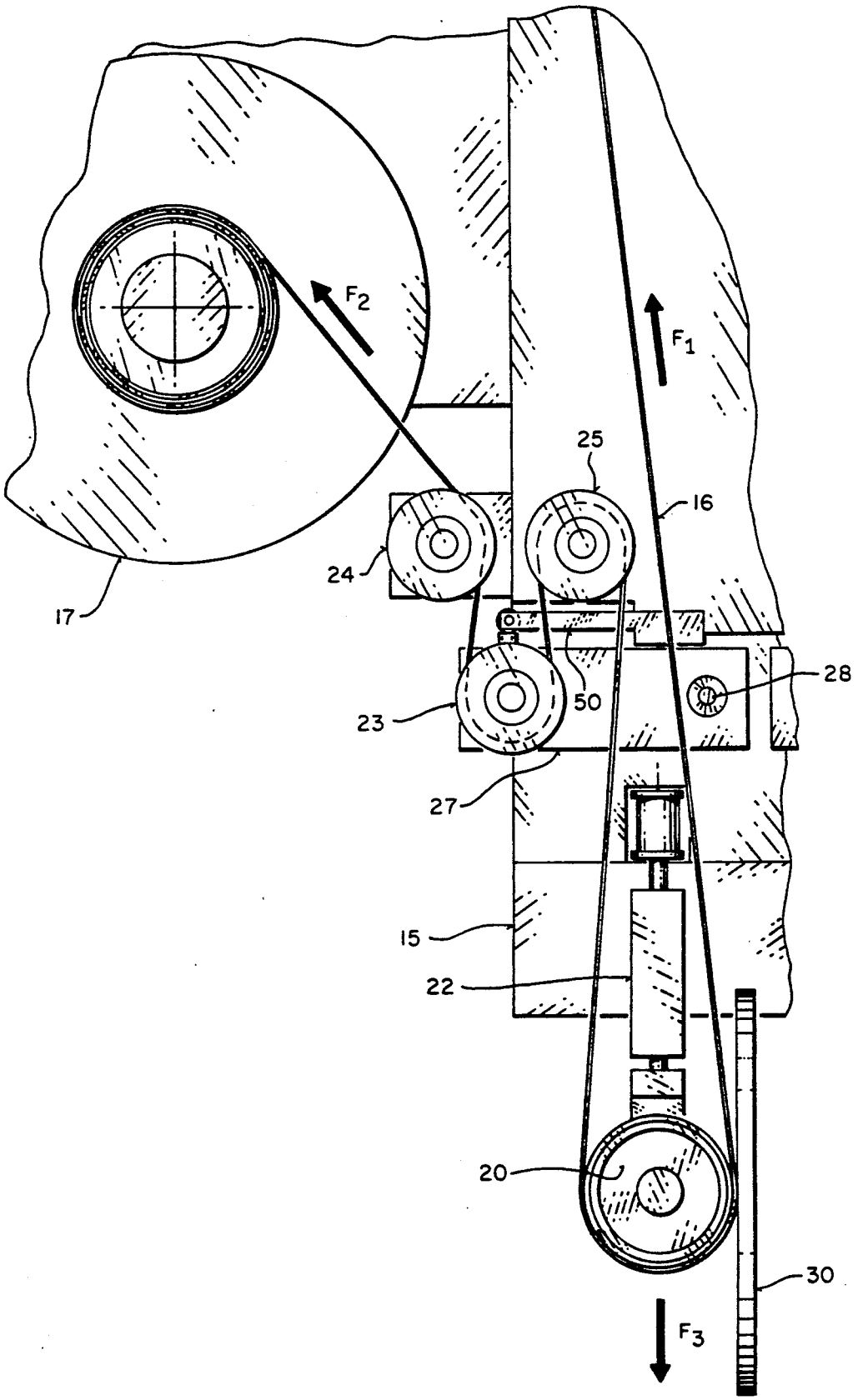
FIG. 3 is an expanded view of the lower portion of the transport mechanism and includes arrows indicating the various components of force which are applied to the tape during processing.

Each of the load rollers 20 of FIG. 1 is mounted to a block assembly 22 which provides a means for positioning rollers 20 in close proximity to the substrate surface on opposite sides of the workpiece. Blocks 22 are mounted onto chassis 15 and are coupled to a force application means—either an electro-mechanical, pneumatic or hydraulic system may be used—to forcefully press each load roller against the side of the workpiece so that tape 16 may abrasively cut grooves into the rotating substrate disk. FIG. 3 shows the orientation of the workpiece 30 in relation to load roller 20. In the preferred embodiment, an electro-mechanical assembly is utilized for applying force to the rollers. Because the force application means associated with blocks 22 and load rollers 20 is relatively non-essential to the understanding of the present invention, it will not be described in further detail.

Each load roller 20 comprises a cylindrically-shaped metal drum having rubber, or other similar material, covering its outer surface. In the preferred embodiment, rubber is used to a thickness of approximately three-eighths of an inch. The length of the roller is usually chosen to be slightly longer than the radius of workpiece 30.

When the load rollers are forced against the substrate surface the rubber compresses to form a flat contact region called the nip. The nip is the area where the actual work (i.e., abrasive cutting) is performed on the disk. The extent to which the load roller is compressed against the disk (i.e., the length of the nip) is generally less than one tenth of an inch in length.

Individual load rollers 20 are mounted to block assembly 22 along an axis which extends through the center of the roller. A bearing system within load roller 20 permits free rotational movement of the load roller around its axis. This allows the load roller to rotate with the speed of tape 16 during texturing.

With continuing reference to FIG. 1, tape guide 13 is shown rotatably mounted onto bracket member 14. Bracket member 14, in turn, is pivotally mounted to chassis 15 along axis 17. The extended portion of bracket member 14 is suspended by the outer end of upper tension beam 65. The other end of beam 65 is rigidly mounted to chassis 15. Preferably, the outer end of beam 65 supports bracket member 14 in space at a point directly under tape guide 13. This insures that the tension developed about guide 13 is not attenuated as it is transferred to beam 65. Note that as tape 16 passes over guide 13 during processing, guide 13 also rotates at an angular velocity which is directly or linearly proportional to the velocity of the tape.

The operation of motor 37 and brake 36 produce a tension in tape 16 which causes bracket member 14 to forcefully press against upper tension beam 65. This generates a strain or deflection in beam 65 which is then measured electronically. The magnitude of the deflection, of course, depends on the applied tension and the material composition of each of the involved elements, particularly beam 65. In the preferred embodiment, beam 65 comprises ordinary aluminum; however, it is appreciated that a variety of other materials may be substituted and still achieve accurate results. Thus, by transferring the tension developed around tape guide 13 to beam 65, a quantitative measurement of the tape tension on the upper end of the assembly is made.

Exactly the same kind of tension sensing means is provided on the lower portion of system 10 to measure tape tension at a point on tape 16 between load roller 20 and take-up reel 17. Tape guide 23 is illustrated in FIG. 1 as being rotatably mounted onto bracket member 27. Bracket member 27 is pivotally attached to chassis 15 at axis 28. Ordinarily, guide 23 and bracket 27 are held in a horizontal position by the tension in tape 16. Bracket 27 is attached to chassis 15 such that if guide 23 did not have tape 16 threaded around its outer surface, it would simply drop downward about axis 28 from the force of gravity.

Once tension is established in tape 16, lower tension beam 50 experiences strain in the same manner as described above in conjunction with beam 65. That is, the pressure exerted against beam 50 by bracket member 27 generates a strain or deflection which is then detected by electronic instrumentation. Hence, according to the invented system, tape tension is measured on both sides of load roller 20—the side of tape 16 feeding into roller 20 from supply reel 11, and also on the side leading away from roller 20 into take-up reel 17. As will be appreciated, this tension measuring scheme is an important aspect of the present invention.

The function of tape guides 12, 24 and 25 may now be described in more detail. Tape guide 12 is located between guide 13 and supply reel 11 so as to be able to slightly deflect the path of tape 16 as it unwinds. Recognize that the radius of the wound tape on reel 11 can vary considerably throughout a processing session (i.e., spanning many disks) depending on how much tape has been used during previous processing cycles.

This means that the angle at which tape 16 unwinds from reel 11 varies with the radius. If tape 16 were passed directly from reel 11 around tape guide 13 without first passing over guide 12, the moment force applied to tape guide 13 would deviate with the radius of the remaining tape on reel 11. In other words, the same tape tension on tape 16 being supplied from reel 11 at different angles would lead to uncertain strain measurements. Obviously, erroneous strain measurements are to be avoided. Therefore, the purpose of guide 12 is to assure that the angle formed by tape 16 as it enters and exits guide 13 remains constant. This guarantees that the force measured by upper tension beam 65 will directly correspond to the actual tension being generated in tape 16 by motor 37 and brake 36.

Tape guides 24 and 25 function in an identical manner with respect to guide 23. Tape guide 24 assures that changes in radius about reel 17 have no influence on the force being applied to guide 23, and therefore to beam 50. Tape guide 25 directs the path of tape 16 around guide 23 such that the entire tension force is applied to beam 50 in an upward direction. Recognize that the placement of reels 11 and 17, along with tape guides 12, 13, 23, 24 and 25 allow tape 16 to be delivered to the disk surface in such a manner that the abrasively-coated side of the tape does not contact anything from the time it leaves reel 11 to the time it reaches the disk. This eliminates the possibility of wear or contamination of the abrasive surface of tape 16 prior to the point at which it contacts the workpiece.

One of the basic features of the presently invented finishing system is its ability to control tape speed and tape tension simultaneously, while providing a quantitative measurement of the actual work being performed at the tape/substrate interface. To better understand how the present invention operates to achieve this goal, consider the following example.

Assume that the user has programmed a certain tape speed and tape tension into the system's computer controller. Further assume that the system is operating in an unloaded condition; that is, load rollers 20 are not in contact with workpiece 30. Referring to FIG. 3, two components of force, (representing the tape tension) are produced along tape 16 as a result. Force $F_1$ represents the drag force being applied to the portion of tape 16 between supply reel 11 and load roller 20. Force $F_2$ represents the pull force applied to tape 16 on the portion of the tape between take-up reel 17 and load roller 20. In the absence of external forces, such as is the case in the unloaded condition, $F_1$ must be equal to $F_2$, or, mathematically, $$F_1 - F_2 = O$$

The tension sensing means comprising upper and lower tension beams 65 and 50, repsectively, are preferably calibrated at this point in the processing cycle. Any difference between the tape tension measurements of beams 65 and 50 in the unloaded position must be due to instrumentation error and the relatively small bearing drag associated with the rollers—assuming, of course, that tape 16 is not accelerating during the calibration sequence. This difference in tension measured across the two portions of tape 16 in the unloaded condition is denoted $\Delta_1$, and is usually stored in a register as a correction factor for later measurements.

When load rollers 20 are loaded onto the surface of substrate 30, a third component of force, $F_3$, is developed on tape 16. The force $F_3$ results from the friction between tape 16 and substrate 30, and is often relatively high due to the abrasive nature of the tape. Since tape 16 advances in the same direction as the direction of rotation of substrate 30, the force $F_3$ acts to reduce the tension on the portion of tape 16 between load roller 20 and take-up real 17. This means that the magnitude of tension force $F_2$ drops whenever rollers 20 are loaded onto the substrate. Mathematically, the relationship between the various forces after the rollers have been loaded onto the substrate is given by the equation $$F_1 - (F_2 + F_3) = O$$

Understand that when the disk is loaded the system is still braking reel 11 to maintain its programmed value of tension. At the same time, motor 37 is maintaining its programmed value of tape speed. (Both motor 37 and brake 36 are controlled using an ordinary servo mechanism. This aspect of the present invention will be described in more detail shortly).

The force $F_3$ is also frequently referred to as the work factor. It represents an inferred value of the actual work being performed by the tape in the region of the nip and is a collective function of each of the various processing parameters: load roller force, disk RPM, the density of the abrasive mineral embedded in tape 16, the value, nature and viscosity of the liquid lubricant being applied, etc. In other words, it is a function of virtually everything that goes on in the texturing process. It is useful to think of the value of $F_3$ as a sort of global statement about what is happening in the processing cycle. For instance, if the applied load roller force were to be increased, that increase would appear quantitatively in the calculation of $F_3$.

One of the important features of the present invention is its capability of calculating the work factor from the measured difference between tension forces $F_1$ and $F_2$. Recall that tension forces $F_1$ and $F_2$ are measured on opposite sides of the nip. The tape tension force $F_1$ is measured using upper tension beam 65, while tension force $F_2$ is measured directly using lower tension beam 50.

Another advantage of being able to calculate $F_3$ directly from tape tension measurements is that it provides the user with a process control tool. By way of example, a user could program a set of process parameters—such as tape tension, tape speed, load roller force, etc.—and obtain a quantitative measure of the actual work being done for that set of parameters. This information could then easily be stored in a database to be used for further experimentation or to create a process history over time. In an in-line system, the information about work factor could also be utilized as a quality control criterion.

Consider a hypothetical situation in which a portion of tape 16 contains a non-uniform distribution of mineral, or that the particle size varies drastically from one section of the tape to another. Such asperities are not uncommon in abrasive tapes used in modern finishing systems. When the defective portion of the tape appears at the nip, the work factor will be observed to change—perhaps drastically. If the work factor changes beyond established control limits, the user is alerted to this condition. In the preferred embodiment, work factor information is recorded into a computer database for future reference. Thus, by simultaneously establishing a constant tape speed and tape tension, the work factor may be continuously monitored by calculating the difference between the tape tension on either side of load roller 20. This allows in-line, real-time quality control in a finishing system.

Tape speed is measured in two locations in the currently preferred finishing system. Referring again to FIG. 2, a transducer 35 is attached to the axis of the rotating drum of tape guide 13. As previously mentioned, tape guide 13 comprises a cylindrical drum which is rotatably mounted to bracket member 14. The axis of guide 13 extends to the back side of bracket 14 and into transducer 35. Transducer 35 acts as a tachometer—converting the rotational motion of tape guide 13 into an electrical signal corresponding to actual tape speed. Since the cylindrical drum of tape guide 13 rotates at exactly the same velocity as does tape 16, transducer 35 measures the true speed of tape 16.

Figure 2:
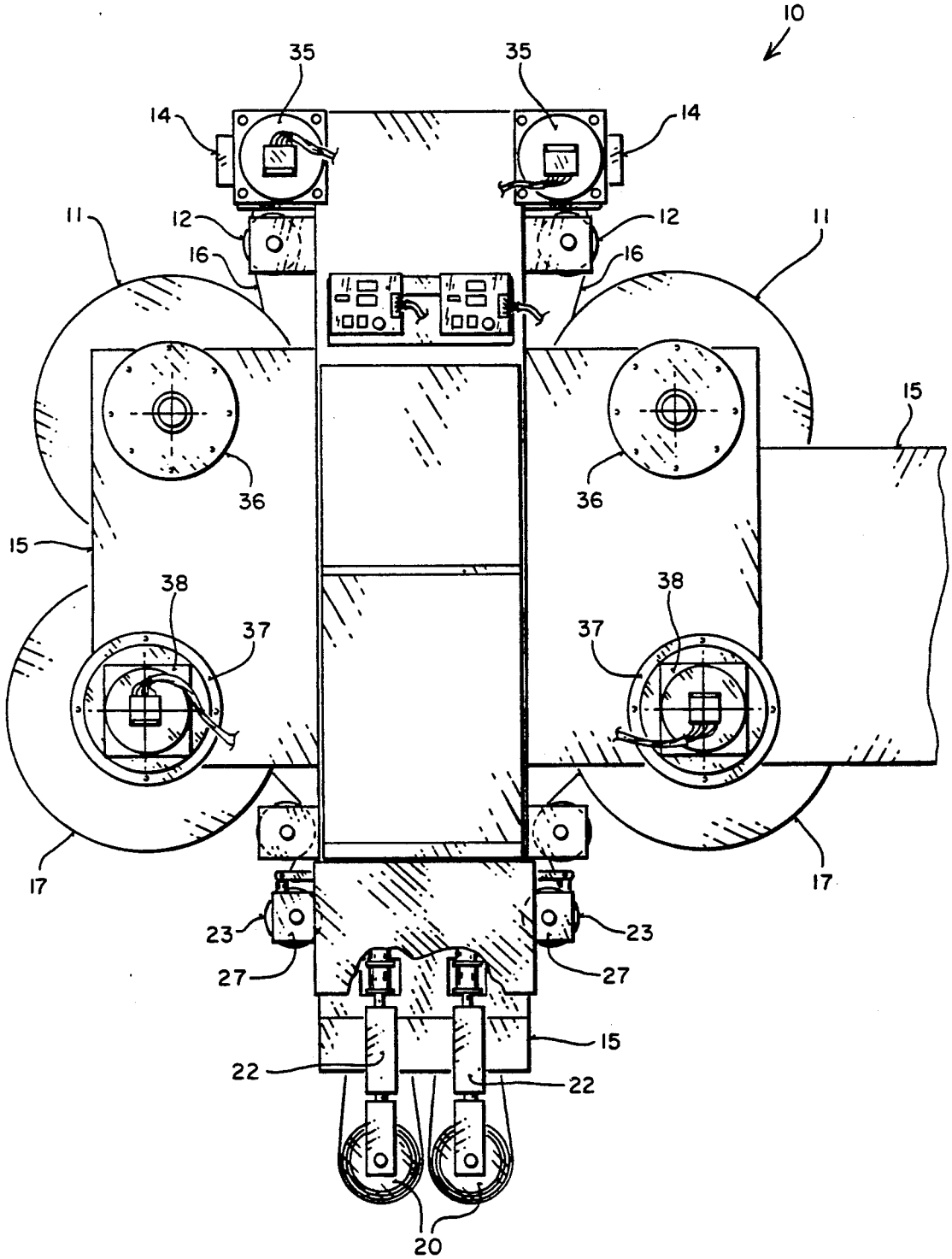
FIG. 2 is a rear view of the apparatus shown in FIG. 1.

Transducer 38 is shown in FIG. 2 attached to the rear of motor 37. The purpose of transducer 38 is to measure the shaft speed of motor 37 as it turns the hub of reel 17. It does not directly measure the actual speed of tape 16. Because the radius of the tape wound around take-up real 17 varies, the ratio of motor shaft speed to actual tape speed also varies. However, during any given processing cycle that ratio remains virtually constant. Therefore, prior to the beginning of a processing cycle, true tape speed is measured using transducer 35. The shaft speed of motor 37 is then measured using transducer 38. The difference between the two, which is denoted $\Delta_2$, is used to calibrate the shaft speed of motor 37 to the actual speed of tape 16. In other words, the calibration process allows the system to determine what shaft speed it needs to drive motor 37 at in order to sustain the programmed tape speed for a given cycle.

For example, when the radius of the tape wound around reel 17 is very small, i.e., near the hub, motor shaft speed more nearly approximates the true tape speed as measured by transducer 35. The difference $\Delta_2$ in this case is relatively small. On the other hand, when the radius of the wound tape around reel 17 is very large, the shaft speed of motor 37 must be considerably slower to achieve the same tape speed. Thus, the difference $\Delta_2$ is used in the calibration scheme to sustain a programmed tape velocity by setting the appropriate shaft speed throughout the processing cycle. Once shaft speed has been calibrated to actual tape speed for a given process cycle, it remains at that speed throughout the cycle. Of course, this tape speed calibration process depends upon the assumption that the radius of the tape wound around reel 17 does not change during the processing cycle. Since only several inches of tape 16 are collected around reel 17 during a single processing cycle of a disk, tape radius is virtually constant.

It is appreciated that immediately upon the loading of rollers 20 against the surface of substrate 30, tape 16 stretches. Until several moments later when the system settles, both the tape speed and the tape tension are in flux. By calibrating the shaft speed of motor 37 in the unloaded condition and then maintaining that speed throughout the processing cycle, the bandwidth of the tape motion control system is effectively reduced to zero during the transient response period when the rollers are loaded. The same is true with respect to brake 36 which is also calibrated prior to loading in order to establish proper tape tension, as will be described in more detail later.

Figure 4A:
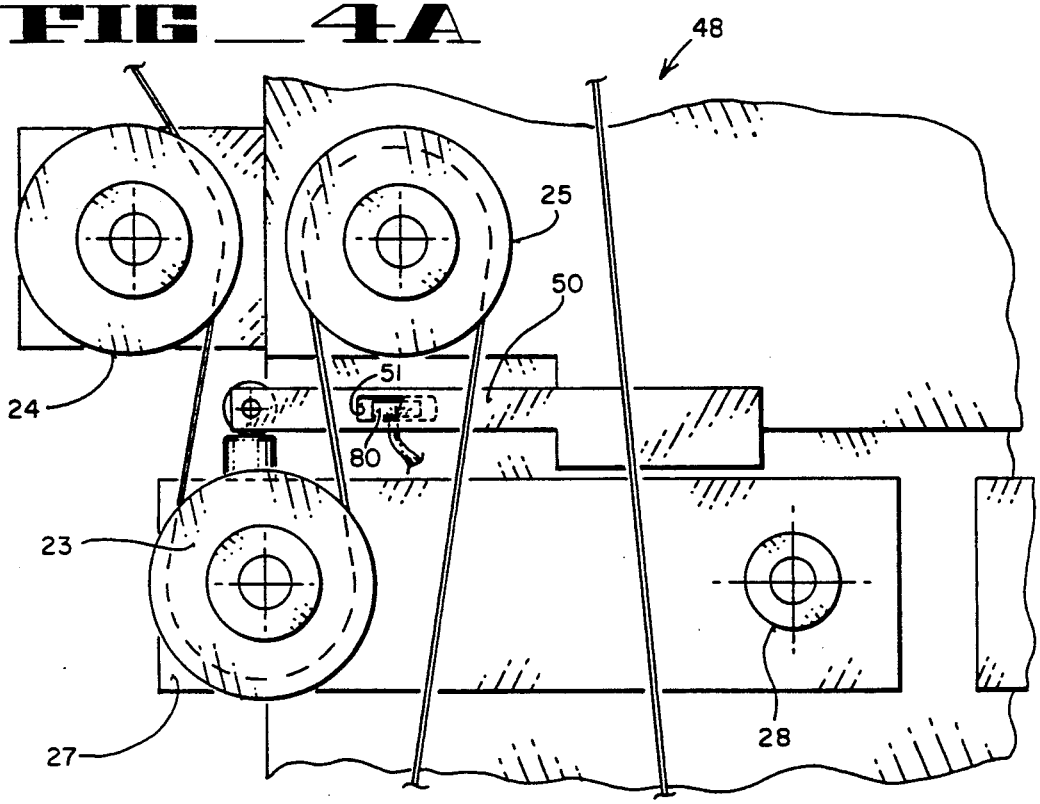
FIG. 4A illustrates a side view of the strain gauge mechanism used to measure tape tension.
Figure 4B:
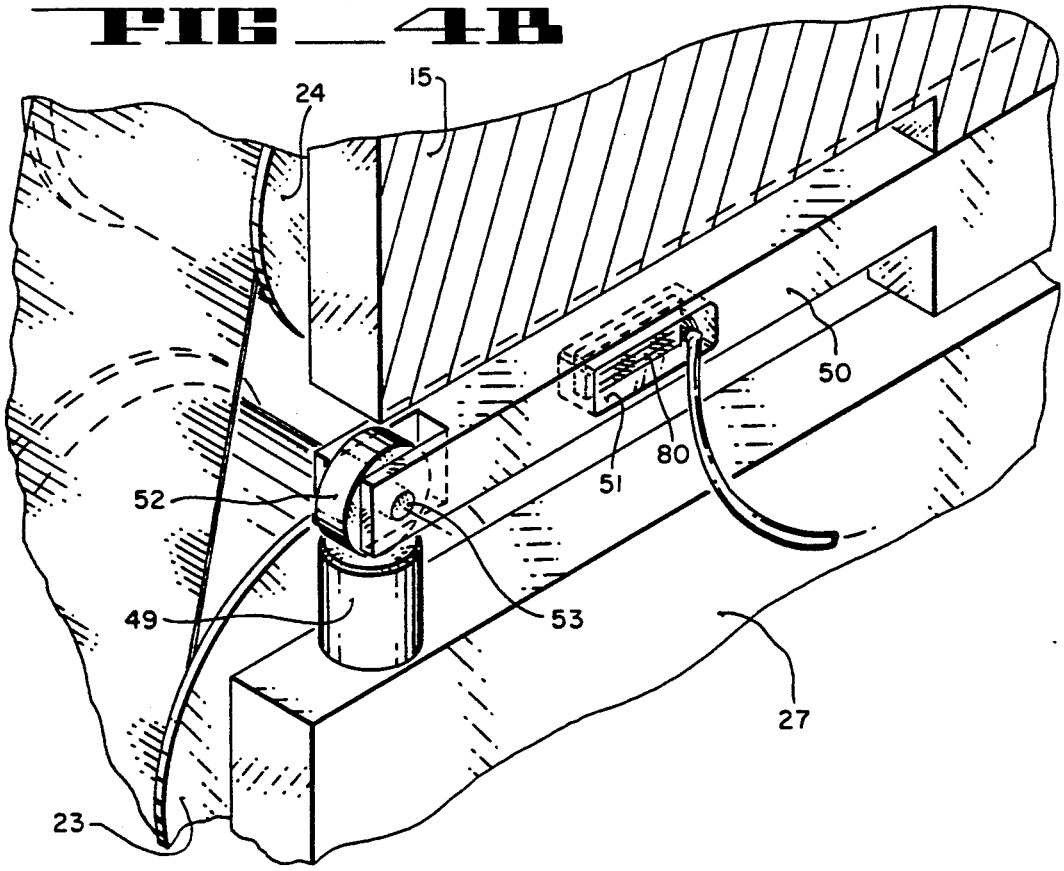
FIG. 4B is a perspective view of the strain gauge mechanism used to measure tape tension.

With reference to FIGS. 4A and 4B, a detailed view of lower tension beam 50 is shown. As described above, bracket 27 is pivotally mounted to chassis 15 along axis 28. Attached to one end of the top of bracket member 27 is protruding pin 49. Pin 49 is located directly above guide 23 and is used to focus the force applied to tape guide 23 onto the extended end of beam 50. In the preferred embodiment, pin 49 comprises an ordinary metal rod inserted into the end of bracket 27. Also included on the outward protruding arm of beam 50 is wheel 52 mounted along axis 53.

As upward force is applied to bracket 27 by the tension in tape 16, pin 49 forcibly presses against wheel 52. This, in turn, creates a strain or deflection in beam 50. This strain is detected by strain gauge 80 mounted along the interior sides of cavity 51. Strain gauge 80 is coupled to an amplifier which converts the strain into an analog voltage. This analog voltage may then be coupled to the system's control circuitry. In the case of a computer controller, this analog voltage is first converted to a digital signal using an ordinary analog-to-digital (A-to-D) converter. Upper tension beam 65 operates in a similar manner to lower tension beam 50. That is, bracket 14 includes a pin 49 which presses against a wheel 52 attached to one end of beam 65 causing a strain therein. The strain is detected by a strain gauge mounted along the interior of a cavity located within beam 65.

Tape speed and tape tension are controlled by servo mechanisms that are interfaced to a microprocessor-based computer which executes the user's process program. The servo mechanisms comprise ordinary closed-loop control systems which are well known to practitioners in the art. By way of example, power is first delivered to motor 37 and also to brake 36 in order to establish an initial tape speed and tension. The servo mechanisms then alter the delivered power until the actual tape speed and tension matched their programmed values.

Figure 5:
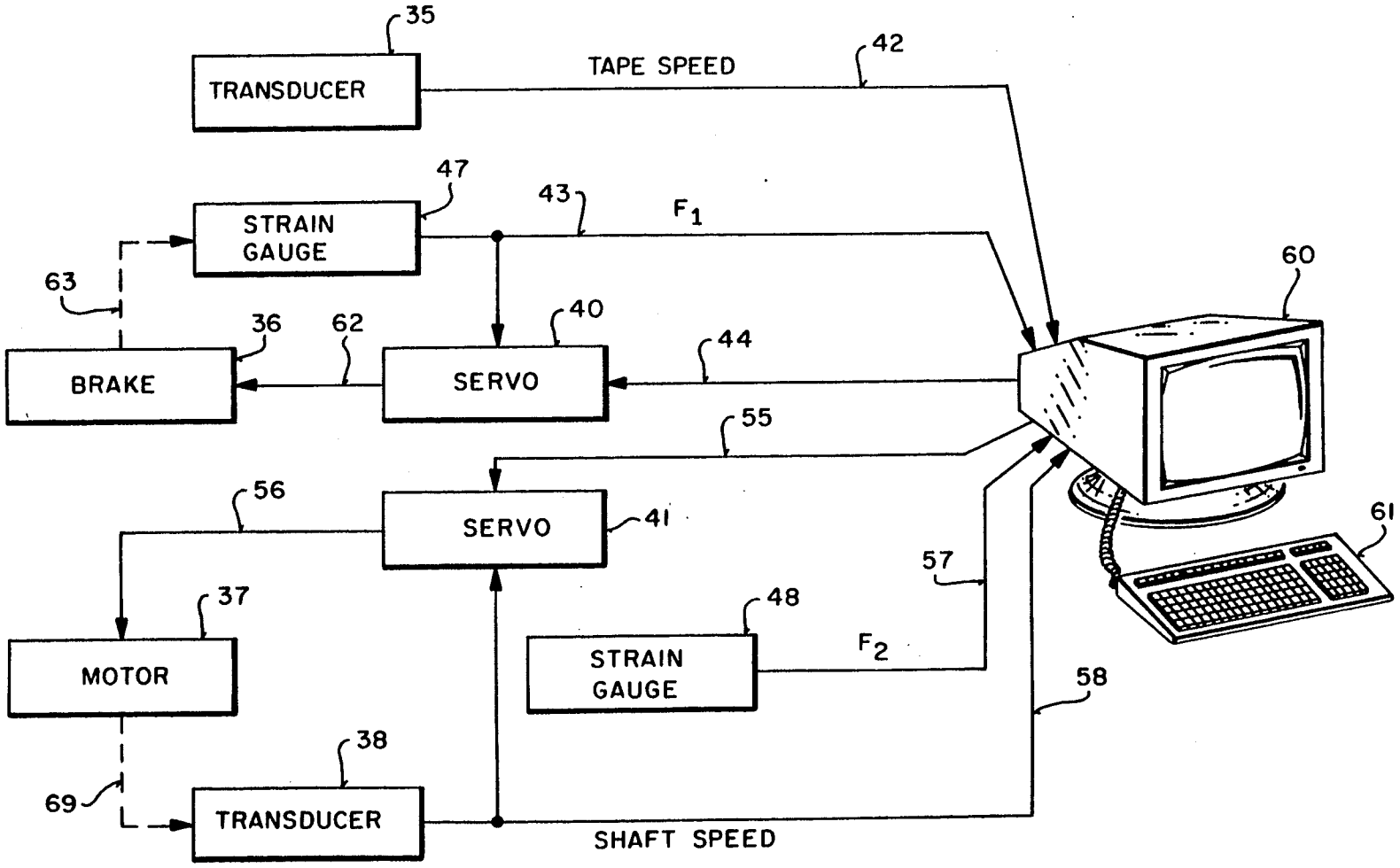
FIG. 5 is a generalized block diagram showing the instrumentation and control elements of the presently invented system.

A block diagram of the overall control system of the currently preferred embodiment of the present invention is illustrated in FIG. 5. The system comprises a computer 60 which executes a program to control the general texturing process. Before the start of a process cycle, all of the important processing parameters are first input to computer 60 through keyboard interface 61. Normally, this includes tape speed and tension, however, other parameters such as load roller force, substrate rotational velocity, etc., may also be optionally input depending on the particular configuration of the finishing system. The inclusion of these other processing parameters as inputs to the process program depends on whether each is controllable by some sort of closed-loop servo mechanism.

In FIG. 5, break tension and motor speed are regulated by computer 60 through servo mechanisms 40 and 41, respectively. As shown, computer 60 supplies a programmed value of tape speed to servo 41 along line 55. Servo 41 then responds by delivering either current or voltage along line 56 to motor 37 to establish an initial speed. At the same time, servo 41 monitors the shaft speed of motor 37 along line 58, which is output from transducer 38. Recall that transducer 38 is coupled directly to the shaft of motor 37. This coupling is shown in FIG. 5 by dash line 69. Motor shaft speed is also provided to computer 60 along line 58. If, for example, servo 41 detects a shaft speed which is higher than its programmed value, it decreases the current or voltage supplied to motor 37 along line 56 until the shaft speed drops to its correct value. Thus, servo mechanism 41 is entirely closed-loop in nature. Once the programmed value of shaft speed is achieved during calibration, it remains at that value throughout the processing cycle.

Servo 40 controls the tape tension generated by brake 36 along line 62. The programmed value of tape tension is received by servo 40 from computer 60 on line 44. Servo 40 also receives a quantitative measure of tape tension from strain gauge instrumentation unit 47 across line 43. Strain gauge instrumentation unit 47 is used to sense the force F1 developed on tape guide 13 and includes a strain gauge 80 along with the required instrumentation for sensing strain and converting it to a suitable signal. The relationship between the action of brake 36 and the tension measured by unit 47 is shown in FIG. 5 by dashed line 63. Tape tension $F_1$ is also coupled on line 43 to computer 60 for calibration purposes and for calculation of the work factor $F_3$.

During calibration, servo 40 controls the current supplied to brake 36 across line 62. It establishes its programmed value of tape tension by comparing the measured value of tension on line 43 to its programmed value received from the computer 60 across line 44. Any deviation between the measured and programmed value causes servo 40 to change the amount of current or voltage being supplied to brake 36. Once the programmed value of tension is achieved, the power being supplied to brake 36 remains constant during the processing cycle in order to maintain a constant tension in the portion of tape 16 located between reel 11 and load rollers 20.

Also shown in FIG. 5 are transducer 35 and strain gauge instrumentation unit 48. Transducer 35 provides a measure of the actual speed of tape 16 along line 42 to computer 60. This measurement is used to calibrate actual tape speed with motor shaft speed during successive processing cycles. Strain gauge instrumentation unit 48 comprises lower tension beam 50 and provides a measure of the tension force $F_2$ to computer 60 along line 57. As previously mentioned, computer 60 utilizes forces $F_1$ and $F_2$ during calibration and also to calculate work factor $F_3$.

Figure 6:
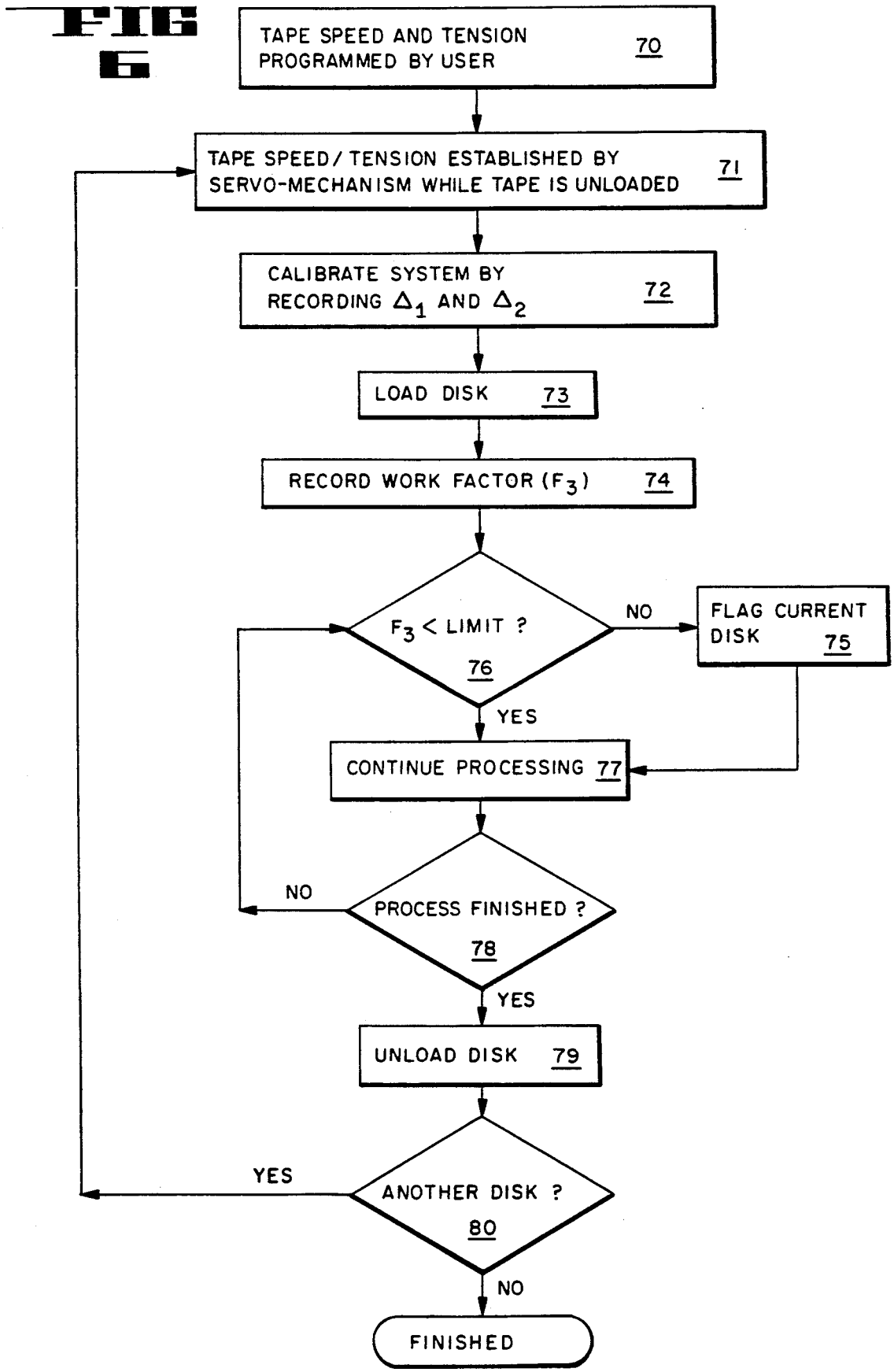
FIG. 6 is a flowchart which illustrates a typical processing cycle according to the currently preferred embodiment of the present invention.

With reference now to FIG. 6, a program flow chart for the currently preferred process is shown. The first step in the processing cycle is the input of the tape speed and tape tension parameters by the user. This is shown by block 70. Certainly, other relevant process parameters may also be input to the program as previously discussed. These optional parameters include load roller force, liquid lubricant flow rate, load roller oscillation rate, etc. In other words, the processing program may be written in such a way as to allow control over any of the process parameters which affect the work being performed at the nip.

Once tape speed and tension have been input by the user, the program begins execution. Tape speed and tape tension are initially established by servo mechanisms 41 and 40, respectively, while the tape is in its unloaded position. After motor 37 is turning at its programmed speed and brake 36 is generating the proper tape tension, the system is calibrated by recording values of $\Delta_1$ and $\Delta_2$.

The correction factor $\Delta_1$ is calculated by taking the difference between the tension measurement recorded by upper tension beam 65 against the measurement recorded by lower tension beam 50. This correction factor is included in the equation for determining work factor $F_3$ The difference $\Delta_2$ is calculated by taking the difference between actual tape velocity measured by transducer 38 as compared to the shaft speed of motor 37 as measured by transducer 39. This establishes the proper motor shaft speed for a given programmed tape velocity during a single processing cycle. Tape speed and tape tension are established in the flow chart at step 71 while the system calibration occurs in block 72.

Once the system has been fully calibrated, the disks may be loaded against the substrate surface. Loading of the disks is indicated by block 73 in FIG. 6. After the disks have been loaded against the workpiece surface, the processing program can begin monitoring the work being performed on the substrate. To do this, the controller repeatedly calculates the difference between the tension force $F_1$ and $F_2$ as sensed by tension sensing beams 65 and 50, respectively. The work factor is then stored for future reference in the computer's database. Recording of the work factor is shown taking place in block 74.

Blocks 75 through 78 show how in-line, real-time quality control monitoring is implemented. Once work on the substrate has commenced, the work factor $F_3$ is monitored continuously to check whether it falls within acceptable quality control limits. As long as the work factor remains within an acceptable range of values, processing continues uninterrupted on that particular disk until completion. However, if at any time $F_3$ exceeds either the upper or lower quality control limit (as may happen for instance where the particle size or mineral density changes drastically on abrasive tape 16), then the program issues a flag to record this condition. For an in-line system, an entry is made in the database indicating that the present disk exceeds acceptable quality control standards. Alternatively, processing may be stopped whenever this limit is exceeded. After the process cycle for a single disk is completed, the load rollers are unloaded from the disk, as is shown occuring at block 79.

At decision block 80 the system queries whether another disk needs to be processed. If so, the system returns to block 71 to establish tape speed and tape tension while the rollers are in their unloaded state. The system is then recalibrated, the disks loaded and processing of the next rigid-disk begins.

The reason why the system goes through a calibration sequence for each processing cycle is that the radius of the tape changes from cycle to cycle as tape is unwound off of supply reel 11 and is collected on take-up reel 17. Other processing variables or instrumentation errors could also be introduced just prior to the beginning of a cycle. Thus, recalibration insures accurate and precise measurements in subsequent processing cycles without adding significantly to the total time of a processing session. (Recognize that the time it takes to change disks between cycles greatly exceeds the period of time needed for recalibration.)

Whereas many alternations and modifications of the present invention will no doubt become apparent to a person of ordinary skill in the art after having read the foregoing description, it is to be understood that the particular embodiment shown and described by way of illustration is in no way intended to be considered limiting. For example, although this disclosure has shown a particular way of measuring tension using strain gauges, and of controlling tape speed by calibrating motor shaft speed to actual tape speed, it is appreciated that other implementations are possible. Therefore, reference to the details of the preferred embodiment are not intended to limit the scope of the claims which themselves recite only those features regarded as essential to the invention.

Thus, a system for texturing the surfaces of a rigid-disk substrate which provides in-line process control has been described.

What is claimed is:

1. In a apparatus for texturing the surface of a rigid-disk substrate using an abrasive tape which is forcibly pressed against said surface by a roller, a method of achieving real-time process control comprising the steps of:

(a) selecting a tape speed and a tape tension for a processing cycle;

(b) establishing said tape speed and said tape tension on a first portion of said tape leading into said roller;

(c) loading said roller to forcibly press said tape against said surface;

(d) simultaneously maintaining said tape tension on said first portion of said tape.

2. The method defined in claim 1 further comprising the additional step of:

(e) calculating the difference between the tension developed on said first portion and the tension developed on a second portion of said tape leading away from said roller, said difference providing a quantitative measurement of the work performed on said substrate.

3. The method defined in claim 2 further comprising the additional step of:

(f) determining whether said difference lies within acceptable quality control limits.

4. The method defined in claim 1 wherein step (b) comprises the steps of:

delivering power to a motor coupled to a first reel used to collect said tape after said tape passes over said roller;

measuring both the actual speed of said tape along said first portion and the shaft speed of said motor;

altering the power delivered to said motor until said actual speed matches said selected tape speed;

calibrating said shaft speed to said selected tape speed.

5. The method as defined in claim 1 wherein step (b) further comprises the steps of:

delivering power to a break coupled to a second reel used to supply said tape to said roller;

measuring the actual tension developed in said tape along said first and second portions;

altering the power delivered to said break until said actual tension matches said selected tape tension.

6. The method as defined in claim 5 wherein said measuring step further includes the step of calibrating the tension measured along siad first portion with the tension measured along said second portion.

7. In a system for texturing the surface of a rotating substrate using an abrasive tape which is pressed against said surface by a roller, a method of controlling the texturing process comprising the steps of:

(a) programming values for a set of controllable process parameters, said parameters including a tape speed and a tape tension;

(b) delivering power to a motor coupled to a take-up reel and also to a brake coupled to a supply reel, said supply reel feeding said tape around said roller, and said take-up reel collecting said tape from around said roller during processing, said motor establishing the actual speed and said brake establishing the actual tension of said tape;

(c) altering said power until said actual speed and actual tension match said programmed tape speed and tape tension;

(d) loading said roller to forcibly press said tape against said surface;

(e) maintaining said tape tension and said tape speed on a first portion of said tape between said supply reel and said roller;

(f) calculating the difference between the tension developed on said first portion of said tape and the tension developed on a second portion of said tape located between said roller and said take-up reel, said difference providing a measure of the work being performed on said surface of said substrate.

8. The method defined in claim 7 further comprising the additional step of;

(g) determining whether said difference lies within acceptable quality control limits.

9. The method defined by claim 7 further comprising the step of calibrating said programmed tape speed with the shaft speed of said motor prior to said loading step.

10. The method defined by claim 9 further comprising the step of calibrating the tension measured in said tape along said first portion with the tension measured along said second portion prior to said loading step.

11. The method defined by claim 7 further comprises the step of recording said difference in a database.

* * * * *